US005221223A

United States Patent [19]

Kao

[11] Patent Number: 5,221,223

[45] Date of Patent: Jun. 22, 1993

[54] ANGLED BUILDING BLOCKS

[76] Inventor: Grace M. S. Kao, 29 Mimosa Dr., Cos Cob, Conn. 06807

[21] Appl. No.: 716,581

[22] Filed: Jun. 17, 1991

[51] Int. Cl.[5] ..... A63H 33/06

[52] U.S. Cl. ..... 446/85; 446/124; 52/608

[58] Field of Search ..... 446/85, 124, 125; 52/608, 609, 610, 611, 574, 102; D21/108; 405/286, 33

[56] References Cited

U.S. PATENT DOCUMENTS

| | | | |
|---|---|---|---|
| 472,590 | 4/1892 | Simpson | 52/574 X |
| 784,476 | 3/1905 | Davis | 52/609 |
| 3,672,110 | 6/1972 | Nordstrom | 52/574 X |
| 4,269,537 | 5/1981 | O'Neill | 52/608 X |
| 4,699,602 | 10/1987 | Giorgi | 446/124 |
| 4,753,622 | 6/1988 | Nakama | 446/85 |

*Primary Examiner*—Mickey Yu
*Attorney, Agent, or Firm*—Thomas M. Freiburger

[57] ABSTRACT

A set of building blocks is provided suitable as a toy, as a design for the construction of structures such as walls, and as a design for the packaging of food and other items. The set includes blocks which are removably connected together. In one embodiment, the block had a top and bottom plane, three end planes and three side planes. The top and bottom plane are parallel to each other. The three end planes are perpendicular to both the top and bottom planes. A first end plane is equal in length to positive integer multiples of the length of each of the second and third end planes. The second and third end planes are perpendicular to a first side plane. The second and third end planes each project from opposite ends of the first side plane. The second end plane is distanced at a point between the first and third end planes. The first side plane is distanced at a point between a second side plane and a third side plane. The second side plane is equal in length to positive integer multiples of the length of each of the first and third side planes. The second and third side planes are opposed upward convergent at 45° angles from the bottom plane extending to the top plane. The length is measured along a line parallel to the side planes and the top and bottom planes. The length of the first side plane is equal to a positive whole number multiple of the height of the block.

15 Claims, 8 Drawing Sheets

Fig. 7
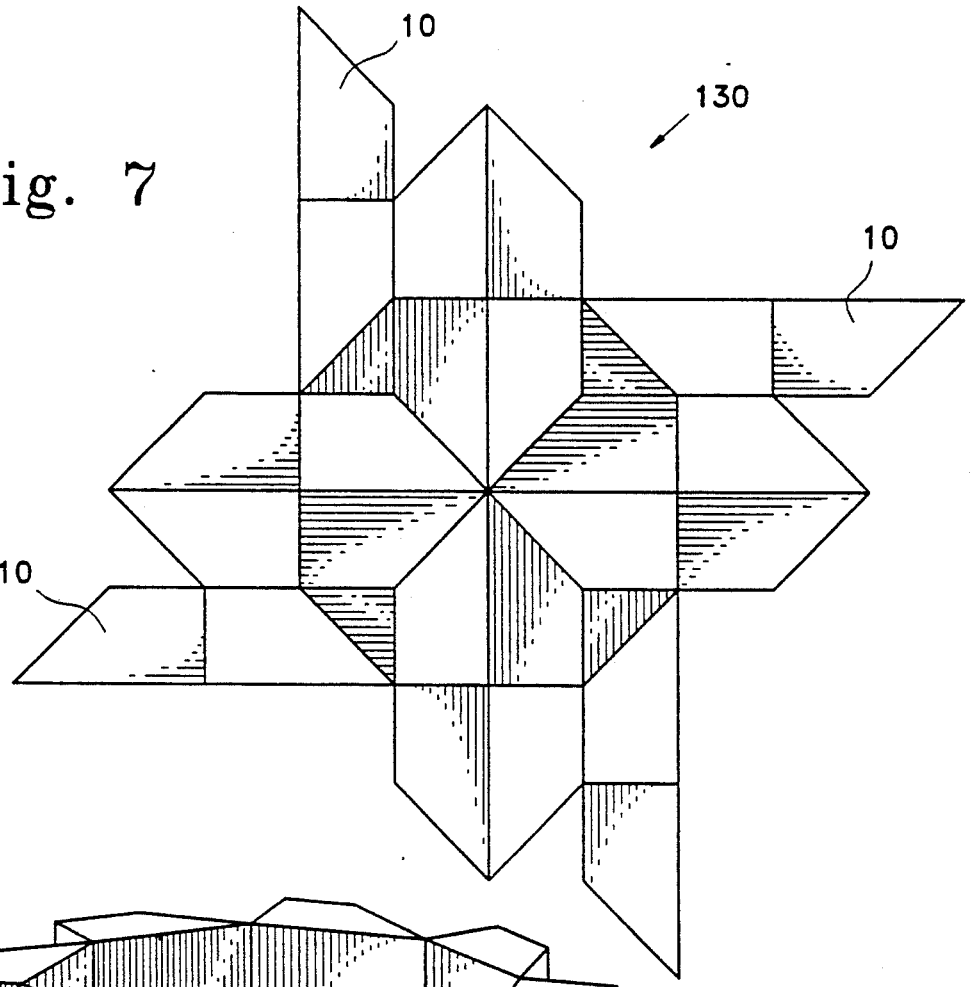
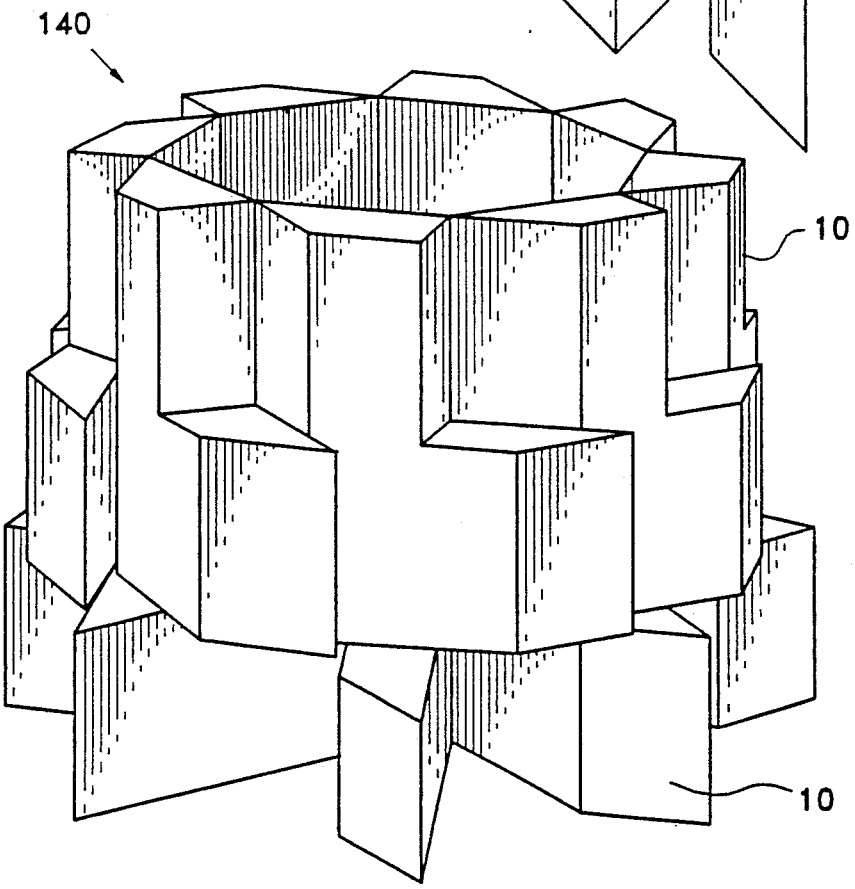
Fig. 8

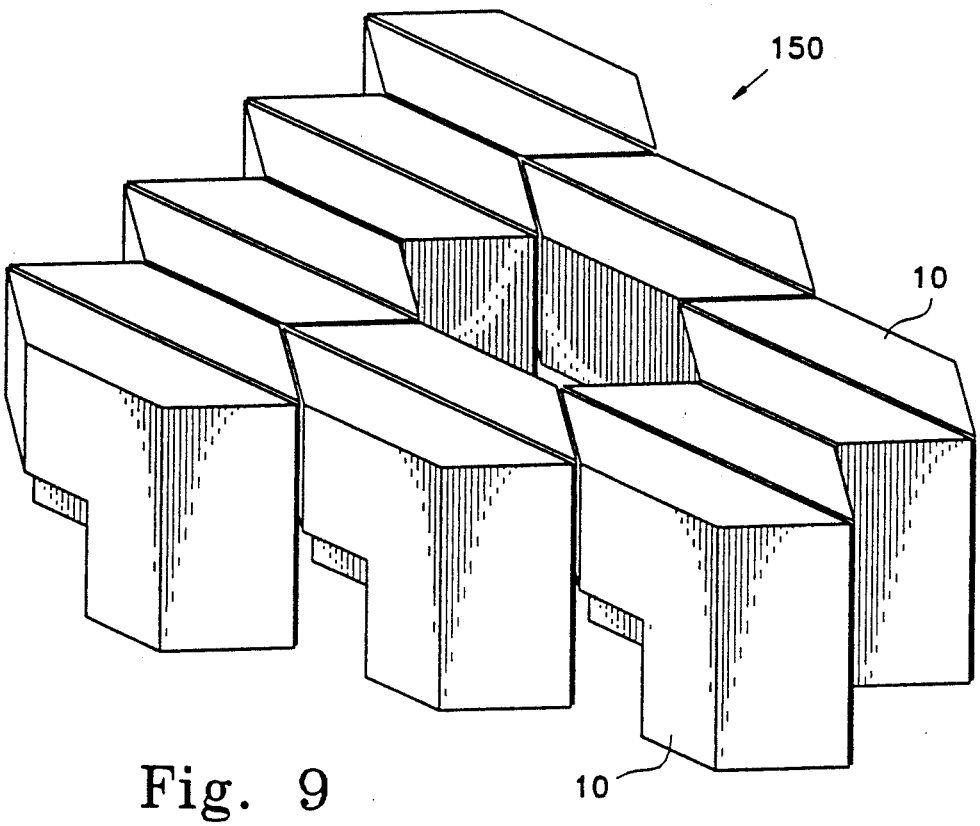
Fig. 9
Fig. 10
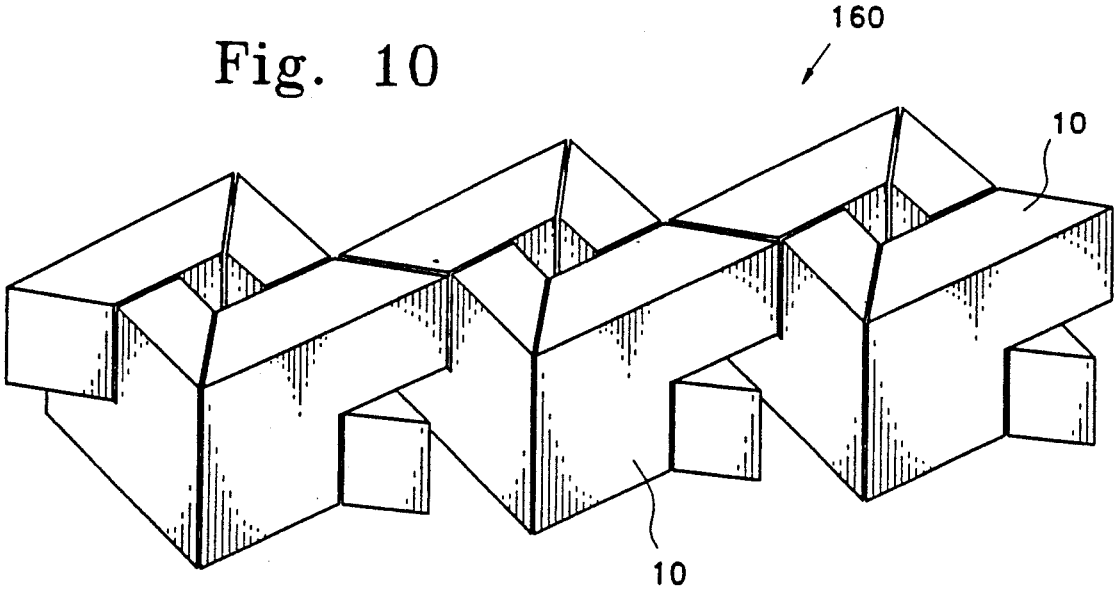

ANGLED BUILDING BLOCKS

SUMMARY OF THE INVENTION

I have devised a set of building blocks that are constructed so as to be capable of being removably connected together to form a structure. According to a first embodiment, each block comprises a top and bottom plane, three end planes and three side planes. The top and bottom planes are parallel to each other. The three end planes are parallel to each other. The three end planes are perpendicular to both the top and bottom planes. A first end plane is equal in length to positive integer multiples of the length of each of the second and third end planes. The second and third end planes are perpendicular to a first side plane. The second and third end planes each project from opposite ends of the first side plane. The second end plane is distanced at a point between the first and third end planes. The first side plane is distanced at a point between a second side plane and a third side plane. The second side plane is equal in length to positive integer multiples of the length of each of the first and third side planes. The second and third side planes are opposed upward convergent at 45° angles from the bottom plane extending to the top plane. The length is measured along a line parallel to the intersection line between the bottom plane and one of the 45° angled side planes. The length of the first side plane is equal to a positive whole number multiple of the height of the block.

For the first embodiment, the length of the first end plane is preferably twice the length of each of the second and third end planes. The second end plane is preferably distanced at a midpoint between the first and third end planes. The first side plane is preferably distanced at a midpoint between the second and third side planes. The height of the block is preferably one quarter of the length of the second side plane.

According to a second embodiment, each block comprises a top and bottom plane, six end planes and six side planes. The top and bottom planes are parallel to each other. The first and second end planes are perpendicular to both the top and bottom planes and a first and second side plane. A third and fourth end planes are perpendicular to both the top and bottom planes and a third and fourth side plane. The bottom plane is equal in length to a positive integer multiple of the length of each of the end planes. The first end plane projects from the end of the first side plane and a fifth side plane. The second end plane projects from the end of the second side plane and a sixth side plane. The third end plane projects from the end of a third side plane and the sixth side plane. The fourth end plane projects from the end of the fourth side plane and the fifth side plane. The fifth end plane projects from the end of the first side plane and the second side plane. The sixth end plane projects from the end of the third side plane and the fourth side plane. The first end plane is coplanar with the second end plane. The third end plane is coplanar with the fourth end plane. The first, second, third and fourth side planes are perpendicular to both the top and bottom planes. The bottom plane is equal in length to a positive integer multiple of the length of each of the side planes. The first side plane is coplanar with the fourth side plane. The second side plane is coplanar with the third side plane. The fifth and sixth end planes are both opposed upward convergent at 45° angles from the bottom plane extending to the top plane. The fifth end plane is perpendicular to the first side plane and the second side plane. The sixth end plane is perpendicular to the third side plane and the fourth side plane. The fifth and sixth side planes are both opposed upward convergent at 45° angles from the bottom plane extending to the top plane. The fifth side plane is perpendicular to the first end plane and the fourth end plane. The sixth side plane is perpendicular to the second end plane and the third end plane. The length of the end planes and the side planes is measured along a line parallel to and at a constant distance from the top and bottom planes. The length of the bottom plane is measured either from the edge of said fifth end plane and said bottom plane to the edge of the sixth end plane and said bottom plane or from the edge of the fifth side plane and the bottom plane to the edge of the sixth side plane and the bottom plane. The length of the bottom plane is equal to a positive whole number multiple of the height of the block.

For the second embodiment, all the end planes are preferably equal in length to one-third the length of the bottom plane. All the side planes are preferably equal in length to one-third the length of the bottom plane. The height of the block is preferably equal to one quarter of the length of the bottom plane.

According to third embodiment, each block comprises a top and bottom plane, two end planes and two side planes. The top and bottom planes are parallel to each other. The end planes are parallel to each other. The two end planes are perpendicular to both the top and bottom planes. Each end plane is equal in length. The two end planes are perpendicular to the two side planes. Each end plane projects from opposite ends of each side plane. The two side planes are equal in length. The two side planes are opposed upward convergent at 45° angles from the bottom plane extending to the top plane. Either the two end planes are equal in length to a positive integer multiple of the length of each of the two side planes or the two side planes are equal in length to a positive integer multiple of the length of each of the two end planes. Length is measured along a line parallel to and at a constant distance from the top and bottom planes. The length of the edge of said bottom plane and the end planes is equal to a positive whole number multiple of the height of the block. The length of the edge of the bottom plane and the side planes is equal to a positive whole number multiple of the height of the block.

For the third embodiment, the two end planes are preferably equal in length to the two side planes. The height of the block is preferably equal to one-quarter of the length of the edge of the bottom plane and the end plane, or the length of the edge of the bottom plane and the side plane.

According to a fourth embodiment, each block comprises a top and bottom plane, four end planes and four side planes. The top and bottom planes are parallel to each other. The four end planes are parallel to each other. The four end planes are perpendicular to the top and bottom planes. The first and second end planes are equal in length to positive integer multiples of the length of a third and fourth end plane, or the third and fourth end planes are equal in length to a positive integer multiple of the length of each of the first and second end planes. The first and second end planes each project from opposite ends of the first side plane. The third and fourth end planes are perpendicular to a second side plane. The third and fourth end planes each project from opposite ends of the second side plane. The first and third end planes are perpendicular to a third side plane. The first and third end planes each project from opposite ends of the third side plane. The second and fourth end planes are perpendicular to a fourth side plane. The second and fourth end planes each project from opposite ends of the fourth side plane. The third and fourth side planes are distanced at a point between the first side plane and the second side plane. The third and fourth side planes are coplanar. The first side plane is equal in length to a positive integer multiple of each of the second, third and fourth side planes. The first and second side planes are opposed upward convergent at 45° angles from the bottom plane extending to the top plane. Length is measured along a line parallel to and at a constant distance from the top and bottom planes. The length of the first side plane is equal to a positive whole number multiple of the height of the block. In an alternative embodiment, only the first side plane is at a 45° angle from the bottom plane extending to the top plane.

For the fourth embodiment, all the end planes are preferably equal in length. The third and fourth side planes are preferably distanced at a midpoint between the first side plane and the second side plane. The first side plane is preferably equal in length to three times the length of each of the second, third and fourth side planes. The height of the block is preferably equal to one-quarter of the length of the first side plane.

According to a fifth embodiment, each block comprises a top and bottom plane, four end planes and four side planes. The top and bottom plane are parallel to each other. The four end planes are parallel to each other. The four end planes are perpendicular to both the top and bottom planes. The first and second end planes are equal in length of to a positive integer multiple of the length of each of the third and fourth end planes. Alternatively, the third and fourth end planes are equal in length to a positive integer multiple of the length of each of the first and second end planes. The first and second end plane are perpendicular to a first side plane. The first and second end planes each project from opposite ends of the first side plane. The third and fourth end planes are perpendicular to a second side plane. The third and fourth end planes each project from opposite ends of second side plane. The first and third end planes are perpendicular to a third side plane. The first and third end planes each project form opposite ends of the third side plane. The second and fourth end planes are perpendicular to a fourth side plane. The second and fourth end planes each project from opposite ends of said fourth side plane. The third and fourth side planes are distanced at a point between the first side plane and the second side plane. The third and fourth side planes are coplanar. The first side plane is equal in length to a positive integer multiple of each of the second, third and fourth planes. The first side plane is at a 45° angle from said bottom plane extending to said top plane. The length is measured along a line parallel to and at a constant distance from said top and bottom planes. The length of said first side plane is equal to a positive whole number multiple of the height of said block.

For the fifth embodiment, all the end planes are preferably equal in length. The third and fourth side planes are preferably distanced at a midpoint between the first side plane and second side plane. The first side plane is preferably equal in length to three times the length of the second, third and fourth side planes. The height of the block is preferably equal to one-quarter of the length of said first side plane.

According to a sixth embodiment, each block comprises a top and bottom plane, four end planes and four side planes. The top and bottom planes are parallel to each other. The four end planes are parallel to each other. The four end planes are perpendicular to both the top and bottom planes. The first and second end planes are equal in length to a positive integer multiple of the length of each of the third and fourth end planes. The first end plane is perpendicular to the first and second side plane. The second end plane is perpendicular to the first side plane and the third side plane. The third end plane is perpendicular to the second side plane and the fourth side plane. The fourth end plane is perpendicular to the third and fourth side planes. The first and second end planes are each projecting from opposite ends of said first side plane. The third and fourth end planes are each projecting from opposite ends of said fourth side plane. The fourth side plane is distanced at a point between the first side plane and the third and fourth side planes. The second and third side planes are coplanar. The first side plane is equal in length to a positive integer multiple of the length of each of the second, third and fourth side planes. The second and third side planes are parallel upward at a 45° angle from the bottom plane extending to the top plane. The length is measured along a line parallel to and at a constant distance from said top and bottom planes. The length of said first side plane is equal to a positive whole number multiple of the height of said block.

For the sixth embodiment, the first and second end planes are preferably equal in length to twice the length of each of the third and fourth end planes. The fourth side plane is preferably parallel to said first side plane. Alternatively, the fourth side plane is preferably parallel to said second and third side planes. Alternatively, the fourth side plane is perpendicular to both said top and bottom planes. The first side plane is preferably equal in length to three times the length of each of the second, third and fourth side planes. The length of the edge of bottom plane and said first side plane is preferably equal to one-quarter of the height of said block.

Optionally, a set of building blocks may be constructed so as to be capable of being removably connected together to form a structure, wherein the set of building blocks contains at least two of the blocks in the above embodiments. The set of building blocks may be used to design and construct structures such as walls.

A set of building blocks may also be constructed so as to be capable of being removably connected together to form a package, which can hold food and other items, wherein the set of building blocks is comprised of any of the blocks as discussed in the above embodiments.

BRIEF DESCRIPTION OF THE DRAWINGS

These and other objects, features and advantages of the invention will be more readily apparent from the following detailed description of the preferred embodiments of the invention in which:

FIG. 4*c* is an elevation view of the fourth embodiment of the present invention showing the top plane, two end planes and three side planes.

FIGS. 7, 8, 9 and 10 are examples of structures assembled by using blocks of the first embodiment of the present invention.

The present invention can be utilized in a number of ways. The description is intended to illustrate the principles of using angled building blocks and not to rigidly define the structure. Alternative building block systems may be applicable without departing from the scope and spirit of the claims.

DESCRIPTION OF PREFERRED EMBODIMENTS

Figure 1A:
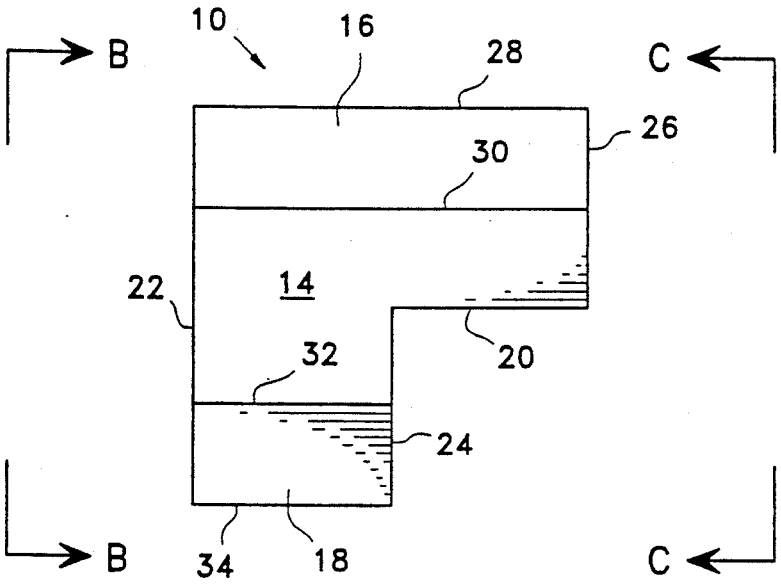
FIG. 1*a* is a top view of the first embodiment of the present invention showing the top plane and two side planes.

In the drawings, FIGS. 1*a* through 1*d* show a first embodiment of a building block 10 in accordance with the invention. The building block 10 is generally L-shaped, with a bottom plane 12 and a top plane 14, also referred to as first and second or rear and front major planar surfaces, respectively. In FIG. 1*a* the surface of the top or front major planar surface 14 is visible, along with the obliquely angled surfaces of the second and third side planes or side planar surfaces 16 and 18, respectively. A first or middle side planar surface 20 is seen in edge view in FIG. 1*a*, as are first, second (middle) and third end planar surfaces 22, 24 and 26, respectively.

Figure 1B:
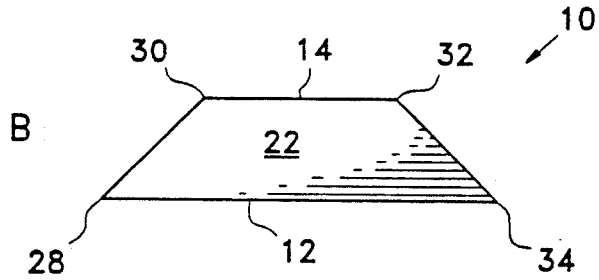
FIG. 1*b* is an elevation view of the first embodiment of the present invention showing an end plane.
Figure 1C:
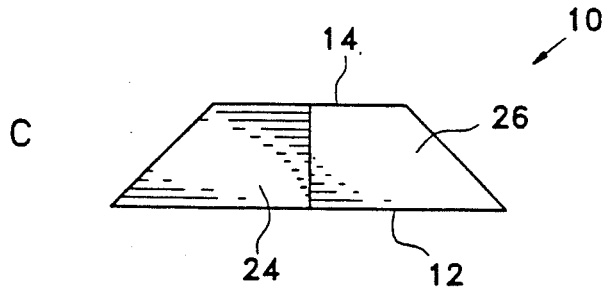
FIG. 1*c* is an elevation view of the first embodiment of the present invention showing two end planes.

FIGS. 1*b* shows the building block 10 as seen from position "B" in FIG. 1*a*, showing the end plane 22 in elevation. FIG. 1*c* shows the building block from the opposite elevation, revealing the second and third end planes 24 and 26.

Figure 1D:
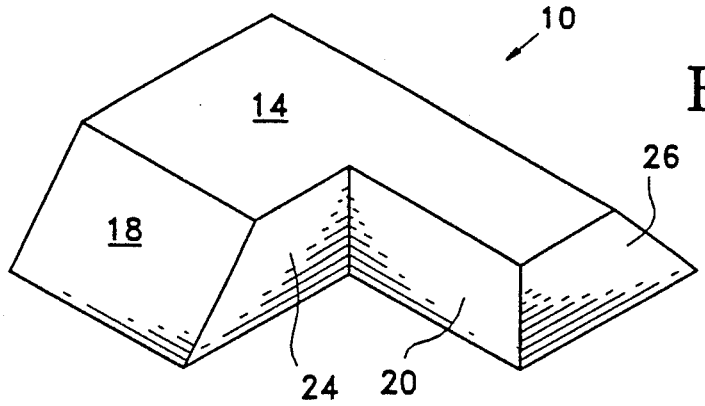
FIG. 1*d* is a perspective view of the first embodiment of the present invention showing the top plane, two end planes and two side planes.
Figure 2A:
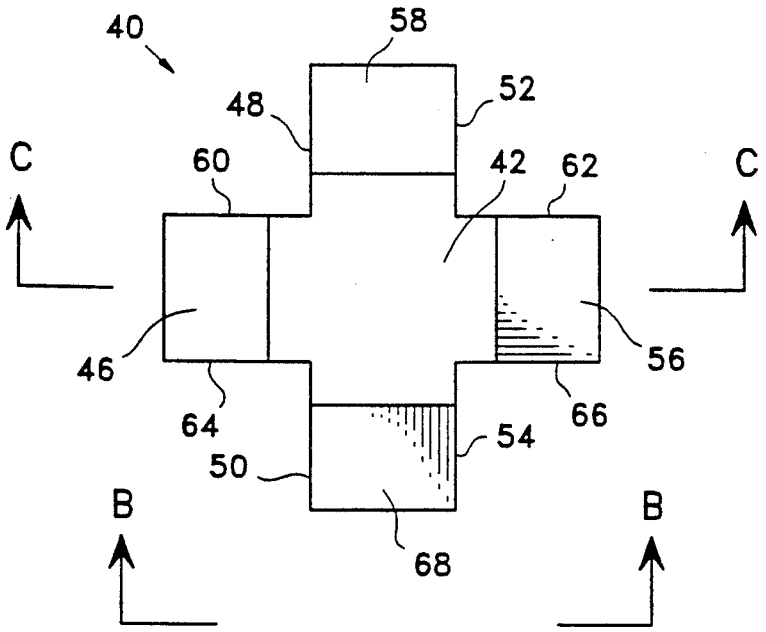
FIG. 2*a* is a top view of the second embodiment of the present invention showing the top plane, two end planes and two side planes.
Figure 2B:
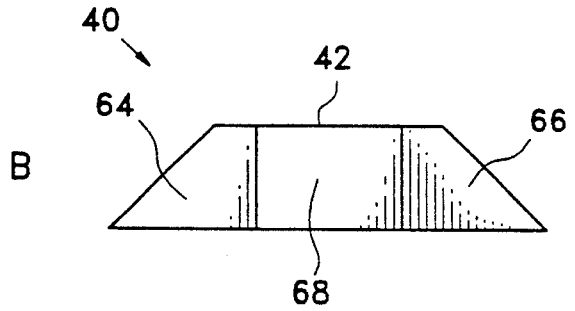
FIG. 2*b* is an elevation view of the second embodiment of the present invention showing a side plane and two end planes.
Figure 2C:
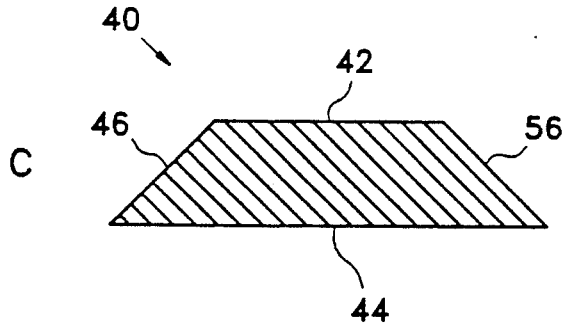
FIG. 2*c* is a sectional view of the second embodiment of the present invention, as seen along the line C in FIG. 2*a*.
Figure 2D:
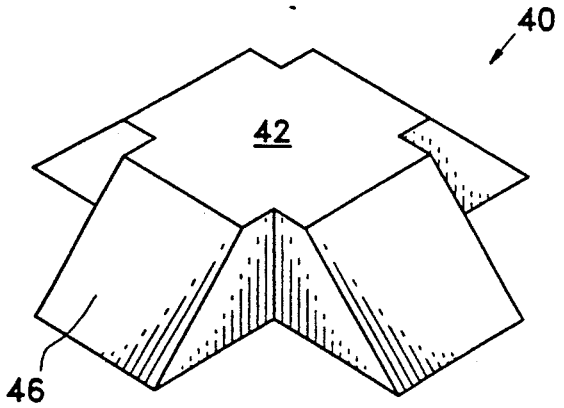
FIG. 2*d* is a perspective view of the second embodiment of the present invention showing the top plane, four end planes and four side planes.
Figure 3A:
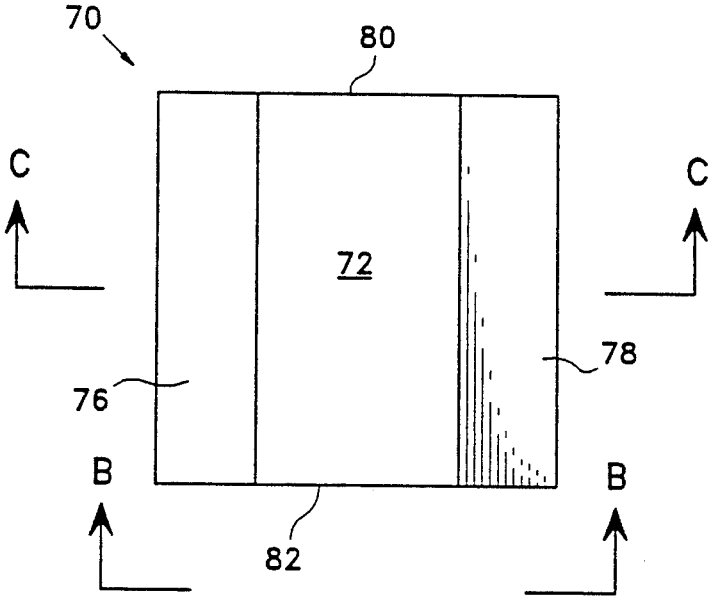
FIG. 3*a* is a top view of the third embodiment of the present invention showing the top plane and the two side planes.
Figure 3B:
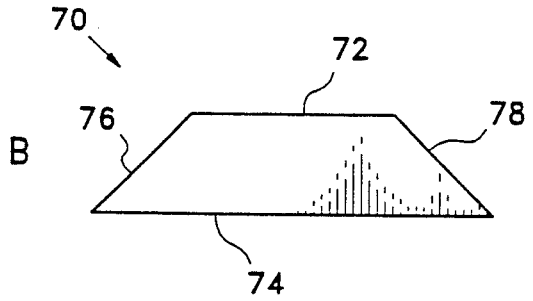
FIG. 3*b* is an elevation view of the third embodiment of the present invention showing a side plane.
Figure 3C:
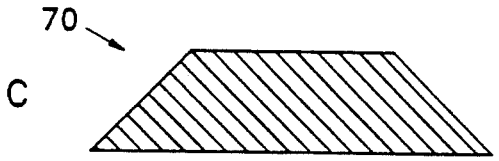
FIG. 3*c* is a sectional view of the third embodiment of the present invention, as seen along the line C in FIG. 3*a*.
Figure 3D:
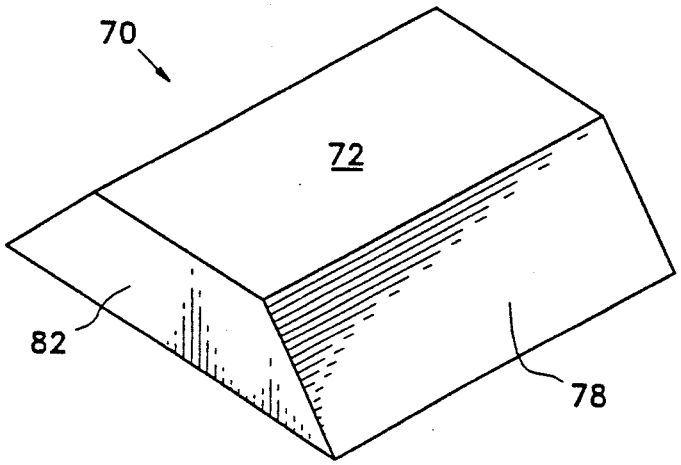
FIG. 3*d* is a perspective view of the third embodiment of the present invention showing the top plane, one side plane and one end plane.
Figure 4A:
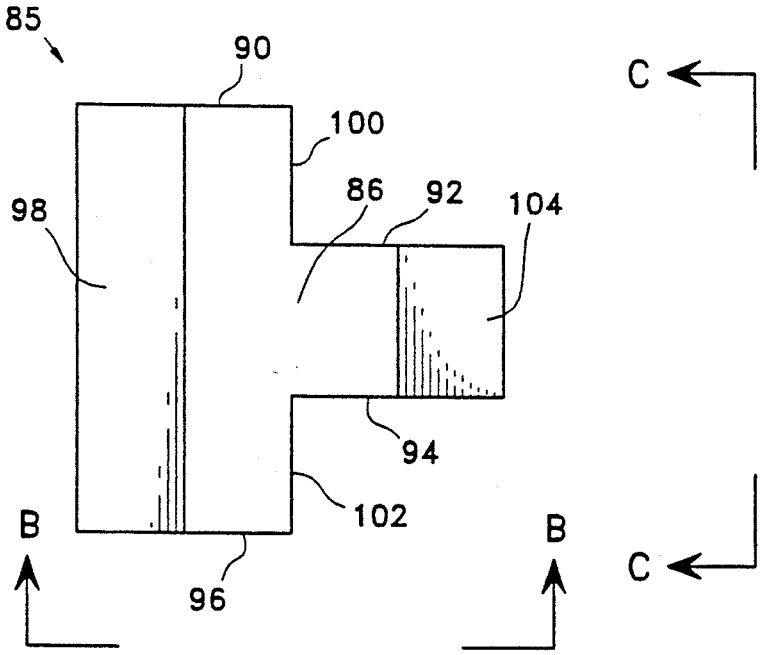
FIG. 4*a* is a top view of the fourth embodiment of the present invention showing the top plane and two side planes.
Figure 4B:
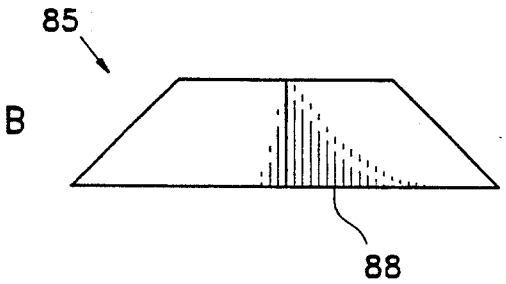
FIG. 4*b* is an elevation view of the fourth embodiment of the present invention showing two end planes.
Figure 4D:
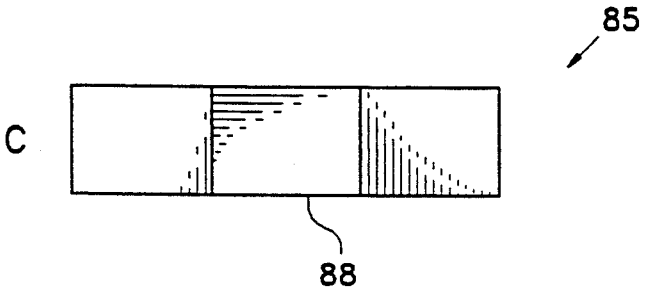
FIG. 4*d* is a perspective view of the fourth embodiment of the present invention showing the top plane, two end planes and three side planes.
Figure 4D:
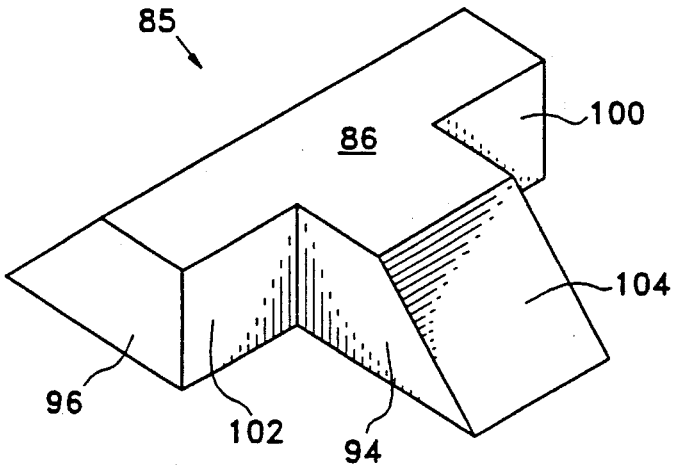
Figure 5A:
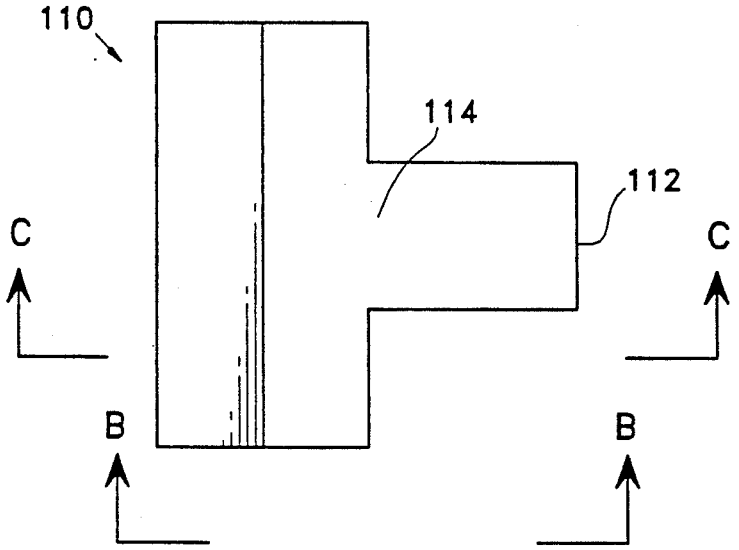
FIG. 5*a* is a top view of an alternative embodiment of the fourth embodiment of the present invention showing the top plane and a side plane.
Figure 5B:
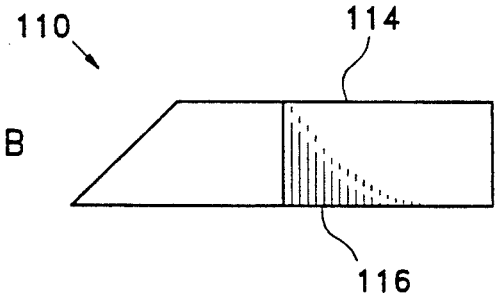
FIG. 5*b* is an elevation view of an alternative embodiment of the present invention showing two end planes.
Figure 5C:
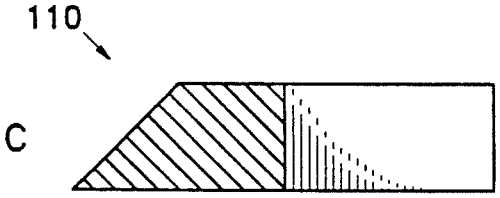
FIG. 5*c* is a sectional view of an alternative embodiment of the present invention, as seen along the line C in FIG. 5*a*.
Figure 5D:
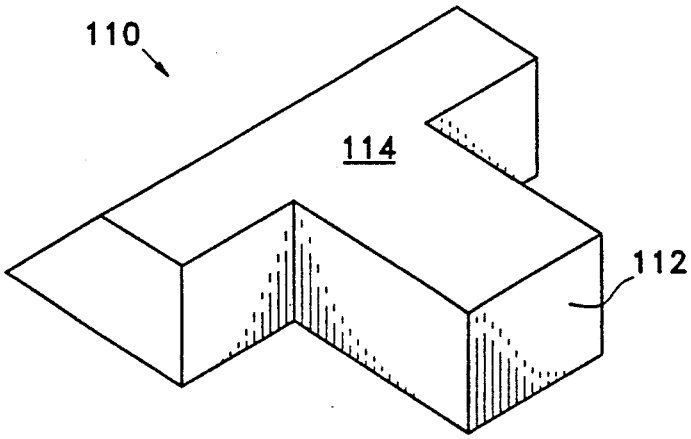
FIG. 5*d* is a perspective view of the fifth embodiment of the present invention showing the top plane, two end planes and three side planes.
Figure 6A:
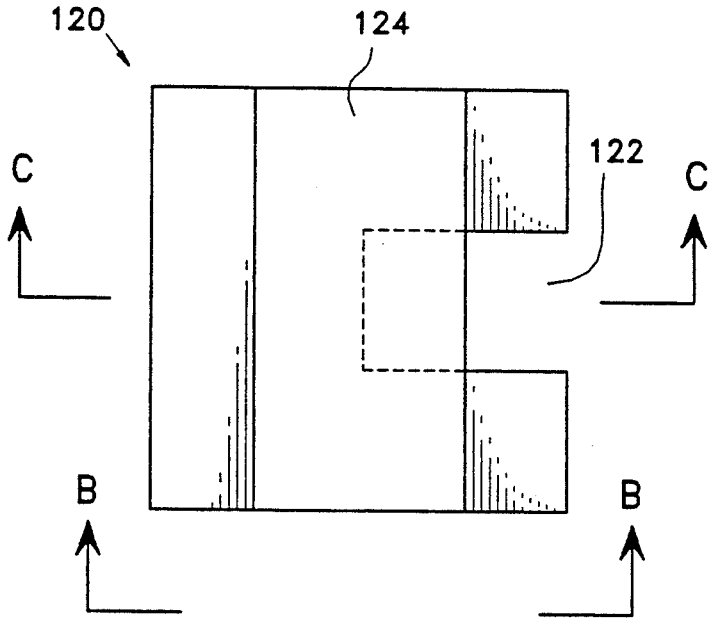
FIG. 6*a* is a top view of the fifth embodiment of the present invention showing the top plane and four side planes. The fourth side plane indicated by dotted lines is parallel to the first side plane and would be obscured from view.
Figure 6B:
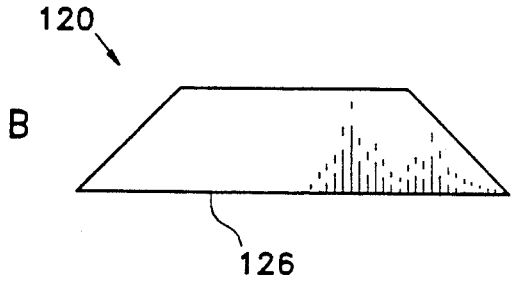
FIG. 6*b* is an elevation view of the fifth embodiment of the present invention showing an end plane.
Figure 6C:
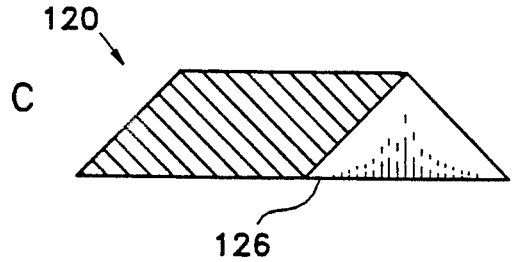
FIG. 6*c* is a sectional view of the fifth embodiment of the present invention showing the fourth side plane, as seen along the line C is FIG. 6*a* parallel to the first side plane. The two alternative embodiments would show the fourth side plane perpendicular to the top and bottom planes, and parallel to second and third side planes, respectively.
Figure 6D:
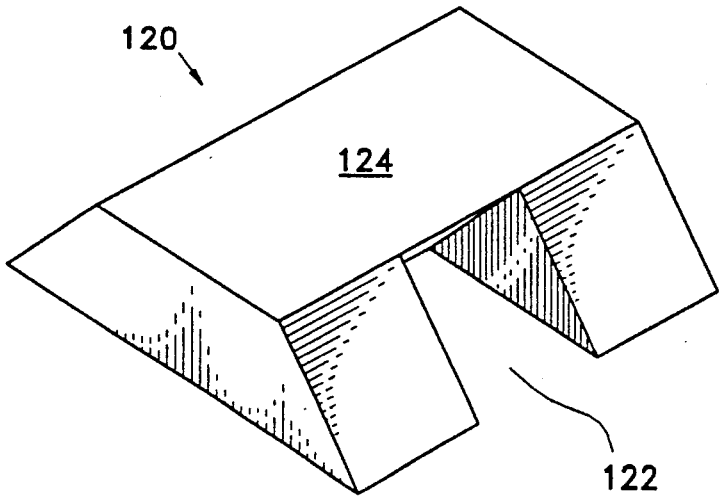
FIG. 6*d* is a perspective view of two alternatives of the fifth embodiment of the present invention showing the top plane, an end plane and two side planes.

FIG. 1*d* shows the block 10 in perspective, showing the top plane or second plane surface 14 and certain of the side and end planes 18, 20, 24 and 26.

As noted above, the length of the block 10, i.e., the length as measured in the longitudinal direction of the longer oblique side plane 16, is an integer multiple of the length of the third side plane 18 and also an integer multiple of the thickness or height of the block. Preferably this length is also an integer multiple of the length of the end plane 22 (the multiple is one in the illustrated embodiment). In the embodiment illustrated, the bottom planar surface (first planar surface) 12 is formed as a square with a square of smaller dimensions cut out of one corner. Thus, as an example, the two legs of the L-shape may each be "2" long at the bottom plane, with a 1" by 1" cut-out removed to form the L-shape. In plan view, the various planes preferably divide the block into four equal sections, defined by lines 28, 30, 20, 32 and 34. These lines are, respectively, the outer edge of the block as defined by the intersection of the side plane 16 and the bottom plane; the intersection of the side plane 16 and the top plane 14; the location of the first side plane 20; the intersection of the top plane 14 with the third side plane 18; and the edge of the block as defined by the intersection of the side plane 18 with the bottom plane. The distance between these lines 28, 30, 20, 32 and 34, as seen in plane view, is always the same as the thickness of the block, in this preferred embodiment.

FIGS. 2*a* through 2*d* show a second embodiment of the invention, generally in an X or cross shape in plan view and including top and bottom planes 42 and 44, six end planes 46–56 and six side planes 58–68. This embodiment has been described earlier.

FIGS. 3*a* through 3*d* show a third embodiment of the invention, in the form of a generally rectangular building block 70. Again the block 70 has top and bottom planes 72 and 74, and includes a pair of side planes 76, 78 and a pair of end planes 80, 82. This embodiment was also described earlier.

FIGS. 4*a* through 4*d* show a fourth embodiment of a building block 85. In this case the building block is generally in a T-shape, with top and bottom planes 86, 88 and with four mutually parallel end planes 90, 92, 94, 96 and four side planes 98, 100, 102 and 104. This embodiment is further described above.

FIGS. 5*a* through 5*d* show a fifth embodiment of a block 110 according to the invention. The block is again in a T-shape, but differs from the fourth embodiment 85 in that a side plane 112 at the base of the T is perpendicular to the top and bottom planes 114 and 116, rather than being at 45° as is the side plane 104 in the block 85 described above.

FIGS. 6*a* through 6*d* show a sixth form of building block 120, also described above. The block 120 is generally rectangular in shape, but with a cut-out area 122. A top plane 124 is rectangular, while a bottom plane 126 (surface not seen) is essentially U-shaped, as can be seen from the drawings.

FIGS. 7, 8, 9 and 10 all show examples of configurations which can be constructed from the L-shaped block 10 illustrated in FIGS. 1*a* through 1*d*. The configurations 130, 140, 150 and 160 shown in FIGS. 7 through 10 help illustrate the importance of the dimensional interrelationships of the various sides, end lengths and thicknesses described relative to the L-shaped embodiment.

As can be seen below with reference to the various configurations constructed in FIGS. 7 through 10, these relationships permit versatility in putting together various configurations.

The above described preferred embodiments are intended to illustrate the principles of the invention but without limiting its scope. Other embodiments and variations to these preferred embodiments will be apparent to those skilled in the art and may be made without departing from the essence and scope of the invention as defined in the claims.

I claim:

1. A set of building blocks constructed so as to be capable of being removably connected together to form structure in many different shapes, including blocks which each comprise:

first and second major planar surfaces, each being larger in area than any other surface on the building blocks, the major planar surfaces being spaced in parallel relationship, at least three end planar surfaces, each having edges which are mutually parallel, at least three side planar surfaces, having edges which are mutually parallel and which are perpendicular to edges of the end planar surfaces, at least one of the side planar surfaces being obliquely angled substantially at 45° with respect to one of the major planar surfaces such that the obliquely angled side planar surfaces of different blocks may be placed together in complementary relationship, including in such a way as to form a right angle between major planar surfaces when obliquely angled side planar surfaces of different blocks are put together, at least two of the end planar surfaces being perpendicular to both the major planar surfaces, the block's major planar surfaces each being generally in an L shape, with a right-angled recess or cut-out forming an intersection between one of the end planar surfaces and one of the side planar surfaces, and wherein the length of one of said major planar surfaces is equal to an integer multiple of the thickness of the block between the major planar surfaces.

2. The set of building blocks of claim 1, wherein the length of one of said major planar surfaces is equal to an integer multiple of the length of at least one of the side or end planar surfaces.

3. The set of building blocks of claim 2, wherein the length of one of the major planar surfaces is equal to an integer multiple of the length of each side planar surface and of each end planar surface.

4. The set of building blocks of claim 3, wherein the first major planar surface is larger than the second major planar surface due to the presence of said obliquely angled side planar surface extending between the two major planar surfaces, and wherein the L-shaped first major planar surface has two legs forming the L shape, at least one leg having a projecting width which is one half the width of the first major planar surface.

5. The set of building blocks of claim 4, wherein the length and width of the first major planar surface are equal and wherein each of the legs of the L shape has a width which is one half and width of the first major planar surface, the first major planar surface thus defining a square with the right-angled recess or cut-out removed from one corner, the right-angled recess or cut-out being square and equal in length and width to projecting widths of the legs.

6. The set of building blocks of claim 5, wherein each dimension of the right-angled recess or cut-out is equal to twice the thickness of the block between major planar surfaces.

7. The set of building blocks of claim 1, wherein the three end planar surfaces include a middle end planar surface midway between the other two end planar surfaces, said middle end planar surface being a surface of the block formed by said right-angled recess or cut-out.

8. The set of building blocks of claim 7, wherein the side planar surfaces include two said obliquely angled surfaces, sloping in opposite directions at opposite sides of the block, and a middle side planar surface which is perpendicular to the major planar surfaces of the block.

9. The set of building blocks of claim 8, wherein the first major planar surface is larger than the second major planar surface due to the presence of said obliquely angled side planar surfaces, the width of the second major planar surface being half the width of the first major planar surface.

10. The set of building blocks of claim 9, wherein the length of the second major planar surface is equal to that of the first major planar surface.

11. A set of building blocks constructed so as to be capable of being removably connected together to form structures in many different shapes, including blocks which each comprise:

front and rear major planar surfaces, each in an L-shape formed of an overall rectangle with a rectangle removed from one corner, the block having at opposite sides two side planar surfaces each being at substantially 45° to one of the major planar surfaces and being at substantially 90° to each other.

12. The set of building blocks of claim 11, wherein the removed rectangle forms two adjacent planar surfaces of the block each of which is perpendicular to the front and rear major planar surfaces.

13. The set of building blocks of claim 12, with three end planar surfaces, all parallel to one another and perpendicular to the front and rear major planar surfaces, one of the adjacent planar surfaces formed by the removed rectangle being a middle end planar surface and being half way between the other end planar surfaces.

14. The set of building blocks of claim 13, wherein the overall rectangle and the removed rectangle are both squares.

15. The set of building blocks of claim 14, wherein each dimension of the removed rectangle is substantially equal to twice the thickness of the block between major planar surfaces.

* * * * *